US005979607A

United States Patent [19]

Allen

[11] Patent Number: 5,979,607

[45] Date of Patent: Nov. 9, 1999

[54] MULTIPLE LEVEL BUILDING WITH AN ELEVATOR SYSTEM OPERABLE AS A MEANS OF EMERGENCY EGRESS AND EVACUATION DURING A FIRE INCIDENT

[76] Inventor: Thomas H. Allen, 1995 Roanoke, Boise, Id. 83712

[21] Appl. No.: 09/052,804

[22] Filed: Mar. 31, 1998

[51] Int. Cl.[6] ..... B66B 1/34; G08B 21/00

[52] U.S. Cl. ..... 187/390; 187/384; 187/393

[58] Field of Search ..... 187/284, 390, 187/393, 391, 380

[56] References Cited

U.S. PATENT DOCUMENTS

| | | | |
|---|---|---|---|
| 3,773,145 | 11/1973 | Drexler | 187/29 R |
| 3,817,161 | 6/1974 | Koplon | 98/39 |
| 4,023,146 | 5/1977 | Carroll | 340/172.5 |
| 4,094,266 | 6/1978 | Artt | 116/64 |
| 4,375,637 | 3/1983 | Desjardins | 340/517 |
| 4,379,499 | 4/1983 | Nowak | 187/29 R |
| 4,410,959 | 10/1983 | Tajima et al. | 187/247 |
| 4,592,270 | 6/1986 | Vener | 98/39.1 |
| 4,677,437 | 6/1987 | Kajiyama et al. | 340/825.79 |
| 4,719,993 | 1/1988 | Ujihara | 187/247 |
| 5,038,894 | 8/1991 | Watanabe | 187/272 |
| 5,195,594 | 3/1993 | Allen et al. | 169/48 |
| 5,383,510 | 1/1995 | Allen | 160/310 |
| 5,593,347 | 1/1997 | Mandy et al. | 454/68 |
| 5,718,627 | 2/1998 | Wicks | 454/68 |

*Primary Examiner*—Robert E. Nappi
*Attorney, Agent, or Firm*—Seed and Berry LLP

[57] ABSTRACT

A building having a plurality of floors, a plurality of detectors, such as smoke detectors, located on the floors, and an elevator system usable for moving building occupants between floors during an emergency condition, such as a building fire. The elevator system includes a control unit that controls movement of an elevator car between selected floors within an emergency evacuation zone for evacuation of building occupants to a designated evacuation assistance floor. The vertical movement of the elevator car is controlled relative to the detection of smoke within the building to increase the efficiency of emergency evacuation. The elevator and smoke detection systems are equipped with an emergency power source for operation in the event of a power outage.

35 Claims, 10 Drawing Sheets

PLEASE USE THE STAIRS
IN CASE OF EMERGENCY.

THIS ELEVATOR IS EQUIPPED FOR EMERGENCY EVACUATION.

*If you are capable of using the stairs, PLEASE do so.*

A BLINKING HALL CALL STATION LIGHT INDICATES THIS ELEVATOR IS AVAILABLE FOR EMERGENCY EVACUATION TO A SELECTED SAFE FLOOR AWAY FROM THIS FLOOR.

THE CAR WILL ONLY STOP AT THE SELECTED SAFE FLOOR. PLEASE SAFELY EXIT THE ELEVATOR AND AWAIT THE ARRIVAL OF EMERGENCY PERSONNEL.

320

*Fig. 8*

MULTIPLE LEVEL BUILDING WITH AN ELEVATOR SYSTEM OPERABLE AS A MEANS OF EMERGENCY EGRESS AND EVACUATION DURING A FIRE INCIDENT

TECHNICAL FIELD

The present invention relates to a multiple level building and, more particularly, to an elevator system utilizing an emergency elevator evacuation control system that allows the use of the elevators as a means of reliable egress and evacuation during an emergency.

BACKGROUND OF THE INVENTION

The Americans with Disabilities Act passed into law assuring all people an equal opportunity to gain access to all buildings used by the general public. Even with the adoption of this law, non-ambulatory people are generally afforded ingress to all buildings but not necessarily given a protected means of egress from the building during emergency circumstances. During a building emergency, such as a fire, ambulatory and non-ambulatory building occupants, even those who are clear thinking people under normal circumstances, can panic or make irrational decisions, which can result in injury to themselves and others.

Faced with a difficult emergency situation, people many times revert to their most comfortable behavior. In terms of leaving a multi-story building during non-emergency conditions, this means using the elevator. People normally arrive at and depart from the upper floors of the building via the elevator, and most never have used the emergency stair system. Given a typical response to an emergency situation, people will retrace their most familiar path of travel, which usually includes passing in front of the elevators as they attempt to find an escape route from the building.

During an emergency situation, elevators are usually taken out of service except for controlled use by the fire department. Accordingly, the building occupants cannot currently use the elevator as a safe and reliable means of egress during the emergency situation, such as a fire. They must therefore attempt either to use an unfamiliar stairway or wait within the building to be rescued. Non-ambulatory and disabled people unable to use stairs have no choice but to await help.

In multiple level buildings it is difficult to evacuate building occupants via the stairs. Generally, there are two classifications of buildings relative to fire and life safety: high-rise buildings and mid-rise buildings. The major distinction is that a standard hook and ladder type fire apparatus can only reach the point of a building about 75 feet or 6 floors above the ground, so "high-rise" buildings, those above about 6 floors, must be evacuated from within the building.

In mid-rise buildings, fire departments use the stairs to transport personnel and equipment to the fire floor, which drastically interferes with the designed egress capacity of the exit stair system. In high-rise buildings, the difficulties with occupant evacuation are compounded. Although the elevator cars can be used by the fire department to transport personnel to a selected staging floor below the fire floor, many times smoke is present in the hoistway shaft by the time of their arrival to the staging floor. Stack effect pressures within the building move large volumes of air through the vertical hoistway shafts. The shafts quickly become smoke filled chimneys and are often capable of transporting smoke throughout the building in a matter of minutes.

Since the fire department cannot reach the building's upper floors from outside the building, the building's occupants are forced to either use an exit stairway to evacuate or remain in the burning building until rescued by the fire department. As the fire department personnel uses one stairway to advance on the fire, the stairway doors are typically propped open with fire hoses, thereby allowing smoke from the fire floor to enter the stairway. Accordingly, that stairway is not suitable for evacuation of the building occupants during an emergency.

The evacuation of people is the primary responsibility of the fire department. The fire department personnel do not begin a fire attack until the building occupants are safe. Conventional evacuation of building occupants, however, is a very time consuming process. During a fire, the chaotic environment increases the complexity and danger of an evacuation procedure, which also usually increases the time required to evacuate the building. It is even more difficult and time consuming to evacuate the non-ambulatory, injured, and disabled occupants.

Even if available for use, conventional elevator systems are an unreliable method of escaping a building fire, and under current regulations, can only be used by the fire department under a narrow range of conditions. For example, the elevator system is not used when there is a high risk of a power outage, because such a power outage will shut the elevator system down and potentially trap passengers between floors. The conventional elevator control system is also easily short circuited by water that enters either the machine room or the hoistway shaft. Smoke is easily drawn into the hoistway shaft by naturally occurring stack effect pressures, and the smoke can quickly fill the hoistway, thereby creating an unsafe environment for people without self-contained breathing devices.

Therefore, the elevators are not usable for building occupants as a reliable means of egress during a building fire. Placards stating "Do not use Elevators during a Fire" are commonly placed next to the hall call stations to notify the occupants of the proper emergency exiting strategy. Ambulatory occupants are therefore forced to use exit stairways to escape a building fire, even from the top floors of mega high-rise buildings.

Conventional Emergency Evacuation Procedures

Even though the fire department response time to arrive at the building is typically less than six or seven minutes, fifteen minutes can easily pass before an evacuation sequence is initiated. The total evacuation time for upper floors of a high-rise building may take up to an hour. During a building fire, time is critical and unnecessary delays can increase the danger of the situation.

In accordance with a typical standard incident command procedure, an incident command post is established in the main floor lobby upon arrival by the fire department. The fire department personnel can then override the elevator system and use the elevators to send an investigation team to a safe point several floors below the fire floor. The investigation team then takes the stairs to the fire floor to assess the extent of the fire involvement and determine the necessary evacuation procedures. Fire Department personnel and equipment are then typically staged two floors below the fire floor and a rescue assistance area is established four floors below the fire floor. Building occupants are then initially evacuated through the stairway to the rescue assistance area.

Conventional Elevator and Fire/Smoke Detection Systems

The basic configuration and operation of an elevator system is well known. A multiple floor building contains a vertical elevator shaft defined by a top, bottom and vertical structural walls through which an elevator car travels between floors. An opening in one of the structural walls at each floor forms a hoistway entrance through which building occupants can safely pass into and out of the elevator car when the elevator car is adjacent to the hoistway entrance during non-emergency conditions. An interlock mechanism connects the elevator car door to the hoistway door when the elevator car is adjacent to the hoistway entrance and the elevator car door opened or closed.

The elevator car's vertical travel in the hoistway is controlled by a conventional elevator control system. The elevator control system typically includes a motion controller and a car controller that receives signals from hall call stations located on each floor. The elevator control system is adapted to position the car adjacent the signaling floor to allow passengers to enter or exit the car. When a "send" or "floor destination" button within the car is activated, a signal is sent to the elevator control system, which in turn moves the car to the designated floor and opens the door to allow passengers to exit the car. Accordingly, the elevator control system permits the building occupants to quickly and efficiently travel between floors of the multi level building during normal conditions.

The typical high-rise building has a fire alarm/smoke detection system, such as a system manufactured by the Simplex Corporation. The fire alarm/smoke detection system is comprised of a plurality of smoke and heat sensing devices which are remotely located throughout the building and capable of detecting the early signs of a building fire. These remote detectors are electrically connected to a central fire alarm panel and are functional to either open or close a series of relay contacts, thereby capable of sending a signal to a building security station, to the fire department, and to an alarm system that alerts the building occupants with audible and strobe alarms. The central fire alarm panel also initiates the operation of fire doors, air conditioning systems, and the like within the building. Many times the fire alarm/smoke detection system also has an auxiliary relay contact as a backup system that is functionally connected to the elevator control system. The elevator control system is programmed, such that when it receives a distinctive signal from the central fire alarm panel, the elevator control system recalls all elevator cars to a predesignated floor, e.g., the lobby floor, and prevents elevator cars from stopping at a floor where smoke has been detected.

Prior to 1973, elevators remained fully operational during a building fire without any safeguards that took into account the location of the building fire. Building occupants on the fire floor trying to quickly escape a fire could push the elevator hall call station buttons and inadvertently call an elevator full of people to the fire floor. Building security personnel investigating a signaling smoke detector could likewise find themselves faced with the fire as the elevator doors opened on the fire floor. Fire temperatures or water flowing from the activation of a fire sprinkler could also short circuit the elevator hall call station buttons and call the elevators to the fire floor, thereby jeopardizing fire department personnel trying to utilize the elevators to stage personnel and equipment.

In an effort to minimize this dangerous situation, all modern elevator systems are equipped with a recall function that is initiated either automatically by the detection of smoke or manually by building security or fire department personnel. The 1996 Edition of the ASME A17.1 code for elevators requires recall on all elevators. Once sent into alarm condition, all hall call stations are de-energized and all elevator cars are automatically recalled to a predesignated floor of the building. If the predesignated floor is the floor where smoke has been detected, the elevator cars are recalled to an alternate floor. The elevators are parked with the doors open and the elevators are temporarily taken out of service. Upon arrival, the fire department can override the recall function by activating a fire department key switch to utilize each elevator car individually. The conventional elevators, however, in an emergency such as a building fire, cannot be used as a safe means of egress of occupants from the building even under the control of the fire department.

Many state of the art buildings are also equipped with a smoke detection system that is designed and installed in accordance with industry standards. At least one smoke detector is located in each elevator lobby and is functionally connected to the elevator control system. Additional remote smoke detectors may be located throughout the building and are functionally connected to the elevator control system. When smoke from a building fire is detected by the elevator lobby detector or by a remote smoke detector, an alarm signal activates building emergency systems, which results in the closing of certain predetermined doors, sounding audible alarms, and the like. The elevator recall function is activated either automatically or manually, and the elevator control system deactivates the hall call stations and the car destination buttons.

If an elevator car is moving upwardly, the elevator control system de-energizes the motion controller, stops the car's ascent, and activates the motion controller to position the car at a predesignated egress floor. If the car is moving downwardly, the elevator control system activates the motion controller to continue the decent to the predesignated egress floor.

Four basic elements are important for an elevator car to be used as an emergency means of egress, which are not all provided by conventional elevator systems: reliable power, a smoke free hoistway shaft, no unshielded electronics in the hoistway or machine room that can be damaged by water, and the ability of the elevator system to respond to changing building conditions due to migrating smoke. Power outages can stall the elevator car, trapping passengers within the hoistway shaft and further consuming fire department resources to locate the stalled car and evacuate the trapped passengers. An emergency power source is only a mandatory building code requirement in buildings above 75 feet to the highest occupied level. Accordingly, there is a need for an elevator system that is usable for emergency evacuation of building occupants during a building fire or other emergency.

One significant reason that conventional elevator systems are not used for emergency egress during a building fire is the danger presented by smoke. Smoke that is present at the hoistway door can also be interpreted by the electronic eye as an obstacle in the elevator doorway, thereby preventing the door from closing properly. Smoke also contains toxic gases and products of combustion that create an untenable environment for people, even at room temperature. Smoke in the elevator hoistway would subject any passengers riding in the elevator car to such an untenable environment and expose them to increased risk.

At least one model building code in the United States prescribes an enclosed elevator lobby in all buildings to separate the hoistway shaft from the remainder of the building in an effort to control smoke. Some building code jurisdictions allow an air pressurization system utilizing the elevator hoistway shaft to create positive air flow from the shaft into the fire floor to blow smoke out of and away from the hoistway shaft. An automatically deployable hoistway door gasketing system is described in U.S. Pat. Nos. 5,195,594 and 5,383,510 to keep smoke from entering the hoistway. Additional methods of providing a smoke barrier at the hoistway door are described in my copending U.S. applications, namely, U.S. patent application Ser. No. 08/732,129, filed Oct. 18, 1996, and U.S. patent application Ser. No. 08/423,958, filed Apr. 18, 1995, each of which is incorporated herein by reference in their entireties.

Another reason for not using the elevator system for egress during an emergency is the risks presented when water gets into the elevator system. Water used for fire suppression, such as from automatic fire sprinklers or from the fire department hoses, is usually present during a building fire. Water can enter the hoistway and short circuit the car controls located on the top of the elevator car. A raised sill at the hoistway door or a slight slope of the lobby floor away from the hoistway door can help prevent water from draining into the hoistway shaft. Water entering the hoistway shaft can also be controlled by the water shield/drainage system for the hoistway door, described in my co-pending U.S. patent application Ser. No. 08/751,306, filed Nov. 18, 1996, which is incorporated herein by reference in its entirety.

The evacuation time as calculated in the "Routine Analysis of the People Movement Time for Elevator Evacuation" is about forty minutes for an eleven story building using a single elevator. A twenty-one story building was estimated to take three hours to evacuate. Interviews of building occupants after actual fire incidents indicate the initiation time from first hearing an alarm to beginning any evacuation sequence may exceed thirty minutes. Therefore, the use of the conventional elevator systems for evacuation is neither efficient nor realistic in its present configuration.

SUMMARY OF THE INVENTION

The present invention is directed toward a transportation system with an emergency evacuation control system that overcomes problems experienced in the prior art and provides additional benefits. One embodiment of the invention provides a multi-story building having a plurality of floors, a plurality of detectors, such as smoke detectors, and a vertical transportation system that is usable for moving building occupants between selected floors during an emergency condition in the building. The vertical transportation system includes a transport unit that is positionable in the building at locations adjacent to selected floors. A transport controller is coupled to the transport unit to move the transport unit to the locations adjacent to the selected floors. A control unit is coupled to the transport controller to send a selected control signal to the transport controller to move the transport unit to one of the floors. The control unit is coupled to the detectors to receive a detector signal from a signaling detector that has detected an emergency condition in the building.

The control unit is programmed to identify the floor where the signaling detector is located and defines that floor as a signaling floor. The control unit is also programmed to define an evacuation zone in a portion of the building relative to the signaling floor. The evacuation zone includes the signaling floor, a priority evacuation floor located one floor away from the signaling floor, and an evacuation assistance floor that is spaced apart from the signaling floor and the priority evacuation floor. The control unit is also programmed to send the control signal to the transport controller to move the transport unit within the evacuation zone and to evacuate the building occupants from the signaling floor and the priority evacuation floor to the evacuation assistance floor during the emergency condition.

Another embodiment of the invention is an evacuation control system having an elevator controller that controls the activities of an elevator car during a building fire or other emergency situation for reliable and continuous elevator operation during the emergency situation. The elevator controller for each elevator car is operationally connected to a central fire alarm panel. The elevator controller is programmed to position the elevator car in selected locations in the emergency evacuation zone during an emergency situation, so as to aid in the emergency evacuation of the building occupants.

According to an exemplary embodiment of the present invention, a smoke detector or preestablished compilation of sensing devices, such as water flow detectors or pull stations, sends the building into an alarm state, thereby initiating the closing of fire doors and dampers, and starting air handling equipment to provide positive pressure in the vertical shafts and enclosed elevator lobby areas. As distinctive, source-identifying alarm signals from the sensing devices are received by the central fire alarm panel, the signals are sent to a central processing unit, translated, and sent to the elevator controller, which is programmed to respond to these distinctive signals.

The elevator controller is programmed to identify a first signaling floor, e.g., the floor from which the alarm signal is generated, as the probable fire floor. The elevator controller is also programmed to define and designate an emergency evacuation zone within the building relative to the first signaling floor (i.e., the fire floor). The emergency evacuation zone is defined by the probable fire floor, the two floors above the fire floor, and one floor below the fire floor. The elevator controller is also programmed to provide evacuation priorities, wherein the first priority is evacuation of the fire floor, and the second priority is evacuation of the floor directly above the fire floor. The third priority is evacuation of the floor directly below the fire floor, and the fourth priority is evacuation of the floor two floors above the fire floor. The elevator controller is also programmed to establish a rescue assistance floor at a selected location away from the fire floor, such as four floors below the fire floor. Accordingly, the elevators are used to evacuate the building occupants to the rescue assistance floor during the emergency situation, wherein the occupants can be attended to by emergency personnel and evacuated from the building if required.

During an evacuation procedure, the elevator controller positions the elevator car or cars at the first signaling floor in a ready state with the car and hoistway doors in an open position. Only the hall call stations in the emergency evacuation zone are operable, and the other hall call stations are deactivated. The hall call stations within the emergency evacuation zone provide a visual notification of the emergency evacuation status by continuously blinking the down button. Audible notification is given by the continuous intermittent sounding of the elevator car arrival bell. A fan located in the elevator car is energized to blow tenable air from the hoistway shaft through the open doors thereby preventing smoke from entering the elevator car.

When any control button on an operating panel in the car is pushed or otherwise activated, the elevator controller closes the elevator doors, moves the elevator car to the predetermined rescue assistance floor, and opens the doors to allow egress out of the car. In one embodiment, the elevator cars are equipped with a recorded-voice enunciator that provides audible instructions to reinforce the egress activity. After the occupants exit the elevator car, the elevator controller closes the doors and repositions the elevator car at the first signaling floor as described above, and awaits a call signal from a floor within the emergency evacuation zone.

When a building occupant pushes the hall call station from a floor within the emergency evacuation zone other than the fire floor, the elevator controller moves the car from the first signaling floor to the calling floor and opens the car and hoistway doors, thereby allowing the occupant to enter the elevator car. The elevator controller then closes the doors, moves the elevator car to the rescue assistance floor, and opens the doors to allow the occupants to exit the car. The elevator car is then returned to the first signaling floor and awaits another call signal.

In accordance with the exemplary embodiment of the present invention, the smoke detectors throughout the building are polled by the centered alarm panel. If a smoke detector located within an elevator lobby senses smoke, a signal is provided to the central alarm panel, and the central alarm panel notifies the elevator controller. The elevator controller then de-energizes the hall call station on the floor where smoke was detected in the elevator lobby and prevents the elevator car from opening its door when on that floor.

The smoke detectors continue to be polled and if smoke is detected within the hoistway shaft or at the elevator car, the elevator controller automatically recalls all elevators traveling within the hoistway to the main lobby floor. At this time all hall call stations and car buttons are de-energized.

The fire department can override the emergency evacuation sequence from the main lobby or the central fire alarm panel and recall the desired number of elevators to the main lobby. By accessing the central fire alarm panel, the fire department can designate additional evacuation floors thereby increasing the size of the emergency evacuation zone, and if desired, to eventually include all floors within the building.

BRIEF DESCRIPTION OF THE DRAWINGS

This invention, along with its many attendant advantages and benefits, will become better understood by reading the detailed description of the invention with reference to the following drawings, wherein:

FIG. 8 is a sign placard located within the elevator car and at each elevator lobby for use with the present invention.

DETAILED DESCRIPTION OF THE INVENTION

Figure 1:
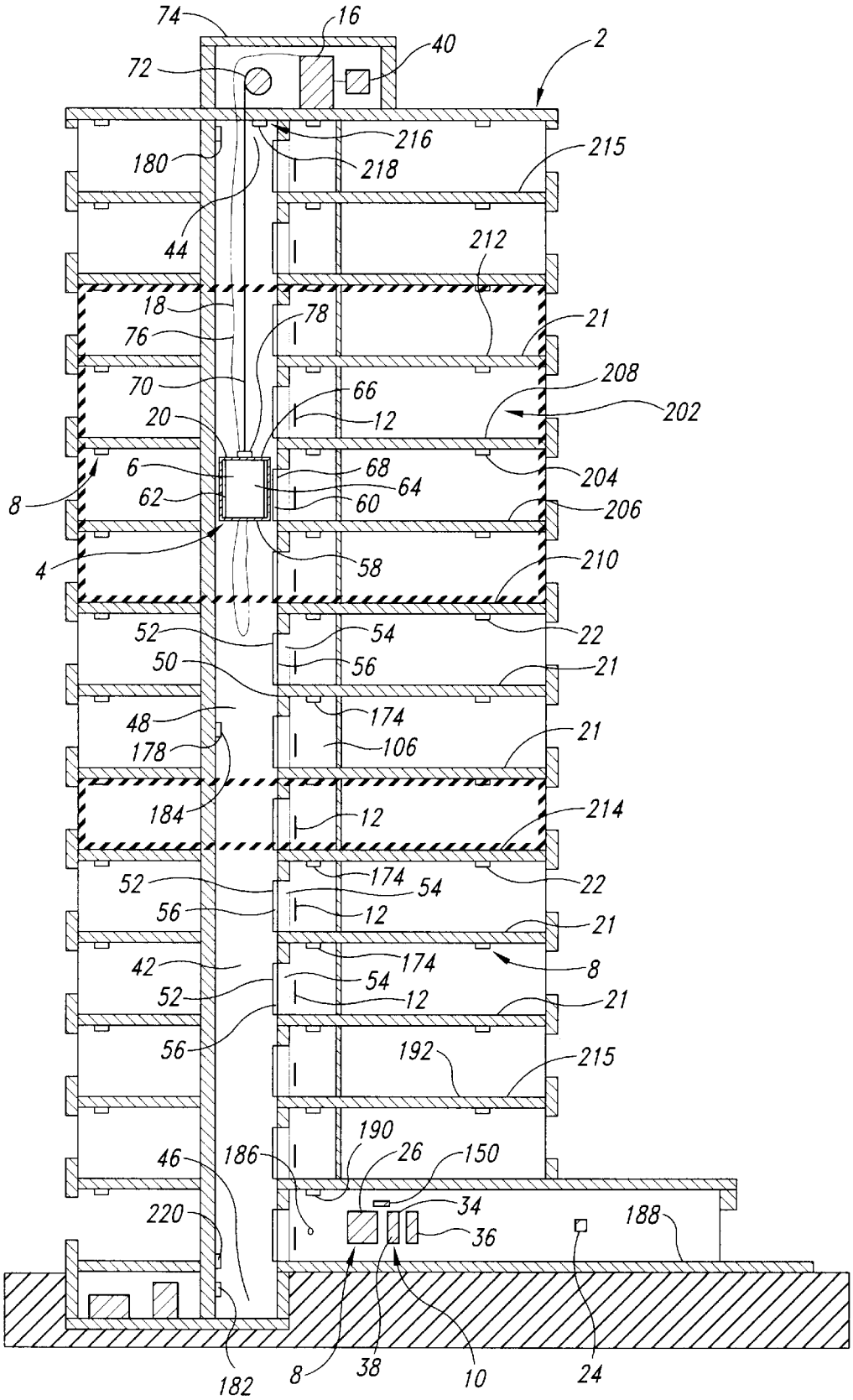
FIG. 1 is a sectional view of a multiple level building with a building egress system in accordance with an embodiment of the present invention, with an emergency evacuation zone and an evacuation assistance floor shown outlined by hash marks for clarification.

Referring now to the drawings wherein like reference characters designate identical or corresponding parts, and more particularly to FIG. 1 thereof, there is shown a multiple level building 2 with a building egress system 4 in accordance with an exemplary embodiment of the present invention. The building egress system 4 includes a vertical transportation system, such as an elevator system 6, that is connected to a smoke and fire detection/alarm system 8 by a communication or interconnection system 10. The elevator system 6, the detection/alarm system 8, and the interconnection system 10 are interconnected to be used during normal, non-emergency conditions and also to allow the elevator system to be used by the building occupants for egress from the building 2 during a fire or other emergency situation.

The elevator system 6 includes at least one elevator car 20 controlled by an elevator controller 16 that moves the elevator car to selected floors 21 of the building 2. The elevator controller 16, such as a controller manufactured by the Dover Elevator Corporation of Memphis, Tenn., includes an interconnected relay network or a central processing unit (CPU) that is programmed with a communication language utilizing an analog or digital protocol for operation and movement of the elevator car 20. The CPU's protocol provides an information feedback loop that maintains a desirable status of operation within the elevator system 6.

The smoke and fire detection/alarm system 8 includes a plurality of smoke/fire detectors 22 that are connected to a fire alarm panel 26 by a detection/alarm communication system 28. The fire alarm panel 26, such as one manufactured by the Simplex Time Recorder Corporation of Gardner, Mass., includes an interconnected relay network or a central processing unit (CPU) that is programmed with a communication language utilizing an analog or digital protocol. The CPU is programmed to locate and identify distinctive, location-identifying signals from individual smoke/fire detectors 22. The CPU is also programmed to send further distinctive signals to conventional control devices 24 in the building 2 to operate specific building functions, such as automatically closing fire doors and a hoistway pressurization system. The CPU's protocol provides an information feedback loop that maintains a desirable status of operation within the smoke and fire detection/alarm system 8.

The interconnection system 10 has an interconnection system operator 34 that is operatively connected to the fire alarm panel 26 and the elevator controller 16. The interconnection system operator 34 includes an interconnected relay network or a central processing unit (CPU) 38 that is programmed with a communication language utilizing an analog or digital protocol, such as one that complies with the ANSUASHRAE 135-1995 BACnet Standard. The CPU 38 is programmed to locate and identify distinctive signals from the fire alarm panel 26 or other individual interconnection system signal initiating devices. The CPU 38 is also programmed to send distinctive signals to the elevator controller 16, or other interconnection system signal responsive devices, to operate specific interconnection functions, such as selectively moving the elevator car 20 in response to the location of smoke and fire during a building fire. The CPU's protocol provides an information feedback loop that maintains a desirable status of operation within the interconnection system 10.

An emergency power supply system 40 complying with industry standards, is connected to the building egress system 4. The emergency power supply system 40 provides continuous secondary power to the building egress system 4 during an outage of primary building power, thereby allowing the elevators to continue to operate during an emergency situation. Accordingly, the elevator system 6, which is responsive to the location of fire and smoke within the multiple level building 2, is usable during building fire or other building emergencies for occupant egress away from the emergency situation in a safe and efficient manner.

The Elevator System

The building egress system 4 of the exemplary embodiment described herein can be used with a single elevator car 20 traveling within a single hoistway shaft 42, or with multiple cars traveling within a common hoistway shaft, or with multiple cars in multiple shafts. The building egress system 4 can also use various types of elevator systems 6 in accordance with embodiments of the present invention.

The elevator system 6 of the exemplary embodiment, as best seen in FIG. 1, includes the elevator hoistway shaft 42 having an upper limit 44, a lower limit 46, and a midpoint 48 with a hoistway wall structure 50 extending therebetween. A hoistway opening 52 in the wall structure 50 is provided at each floor 21 of the building 2, defining a hoistway entrance 54 that is closable by a movable hoistway door assembly 56. The hoistway shaft 42 contains at least one elevator car 20 that is movably positionable between floors 21. Each elevator car 20 includes a car floor platform 58, a front panel 60, a rear panel 62, side panels 64, a ceiling/roof panel 66, and a movable car door assembly 68. The car door assembly 68 is movable with the hoistway door assembly 56 between closed and open positions to allow people to enter and exit the elevator car 20.

Each elevator car 20 is connected by a car support cable 70 to a motion controller 72 that is located in a machine room 74 positioned above the hoistway shaft 42. In an alternate embodiment, the elevator car 20 is a part of a hydraulic elevator system (not shown), and the elevator car is attached to a hydraulic piston that is operatively connected to the motion controller 72. The motion controller 72, such as a conventional motor driven drum, a hydraulic pump, or the like, is coupled to an elevator communication system 18. The motion controller 72 receives and sends distinctive signals from the elevator controller 16, which receives distinctive signals from elevator call devices 12, or other signal initiating devices, located at each floor 21. The motion controller 72 and elevator controller 16 control the vertical motion and positioning of the elevator car 20 between the building's floors 21 in response to the signals from elevator call devices 12 on each floor 21.

Figure 3:
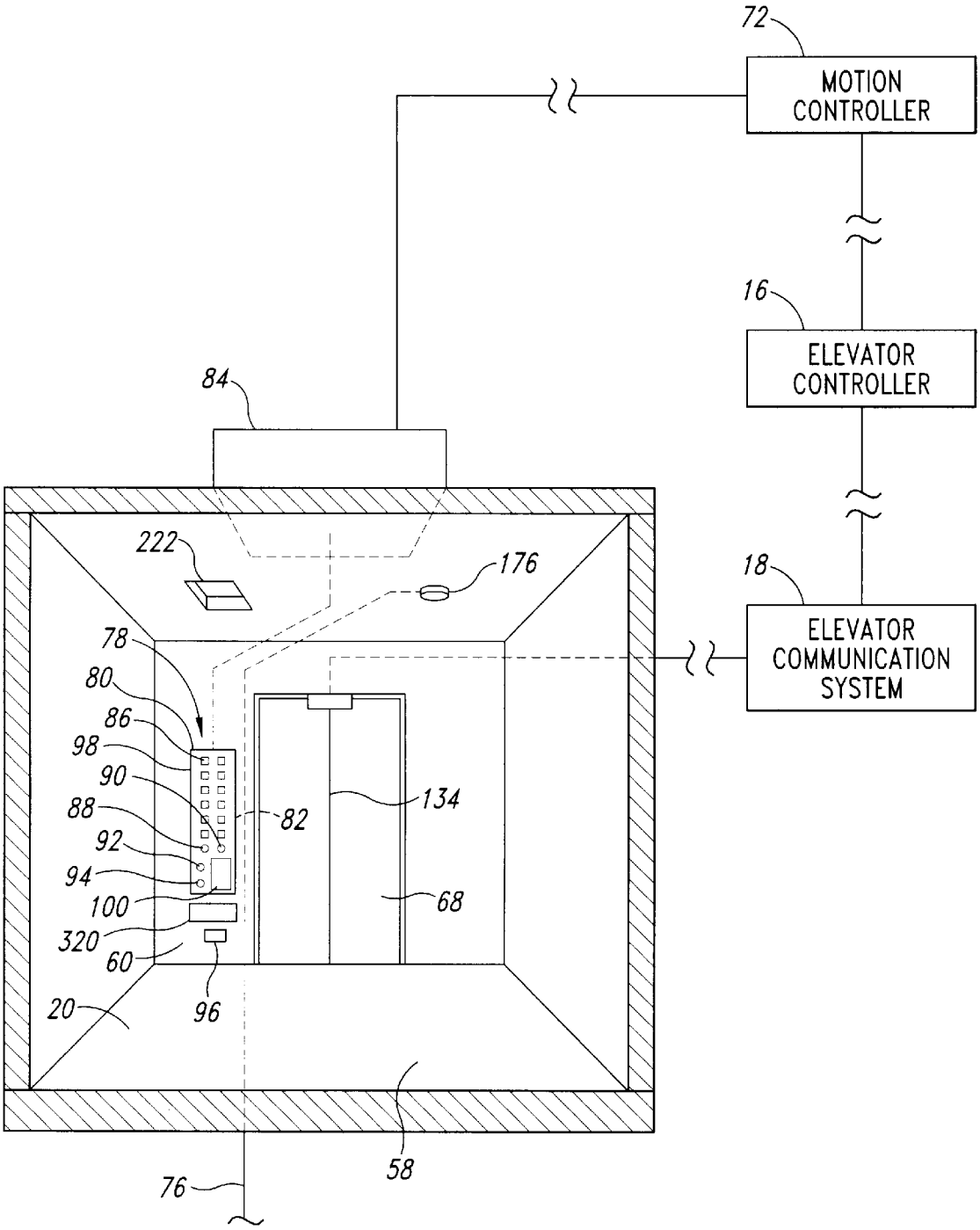
FIG. 3 is an enlarged schematic perspective view of an elevator car in the building of FIG. 1.

The elevator controller 16 is connected to one end of a traveling cable 76 of the elevator communication system 18, and the traveling cable's other end is connected to a car control communication system 78 that is mounted on the elevator car 20, as best seen in FIG. 3. Accordingly, the traveling cable 76 operatively connects the elevator car control communication system 78 to the elevator controller 16. The car control communication system 78 includes remote car control devices 80 mounted within the elevator car 20, signal responsive devices 82 operatively connected to the car control devices, and an elevator car controller 84 that is also operatively connected to the car control devices.

The car control devices 80 in the exemplary embodiment include a plurality of destination buttons 86, a door open button 88, a door close button 90, an emergency stop button 92, an emergency fire service override switch 94, and an audible car notification device 96. The car control devices 80 are located on a car operating panel 98 and are functional to send and receive distinctive signals to and from the car controller 84 and the elevator controller 16 (FIG. 1). An emergency elevator telephone 100 located within a front panel 60 of the elevator car 20 is likewise connected to the traveling cable 76 and terminates at a building maintenance office, not shown, or an automatic dialer connected to an outside telephone line.

Each destination button 86 is operatively connected in a conventional manner to the elevator controller 16 (FIG. 1) via the traveling cable 76. When a destination button 86 is activated, the destination button generates a distinctive signal that is received by the elevator controller 16. The elevator controller 16 energizes the motion controller 72 to move the elevator car 20 to the desired floor. When the elevator car 20 is in registration with the hoistway opening 52 of the selected floor 21, the car goes through a conventional ingress/egress cycle, wherein the car door assembly 68 and hoistway door assembly 56 (FIG. 4) are opened to allow passengers to enter or exit the car. After a selected period of time the door assemblies 68 and 56 are closed. The elevator car 20 is then ready to move to the next selected floor 21.

Figure 4:
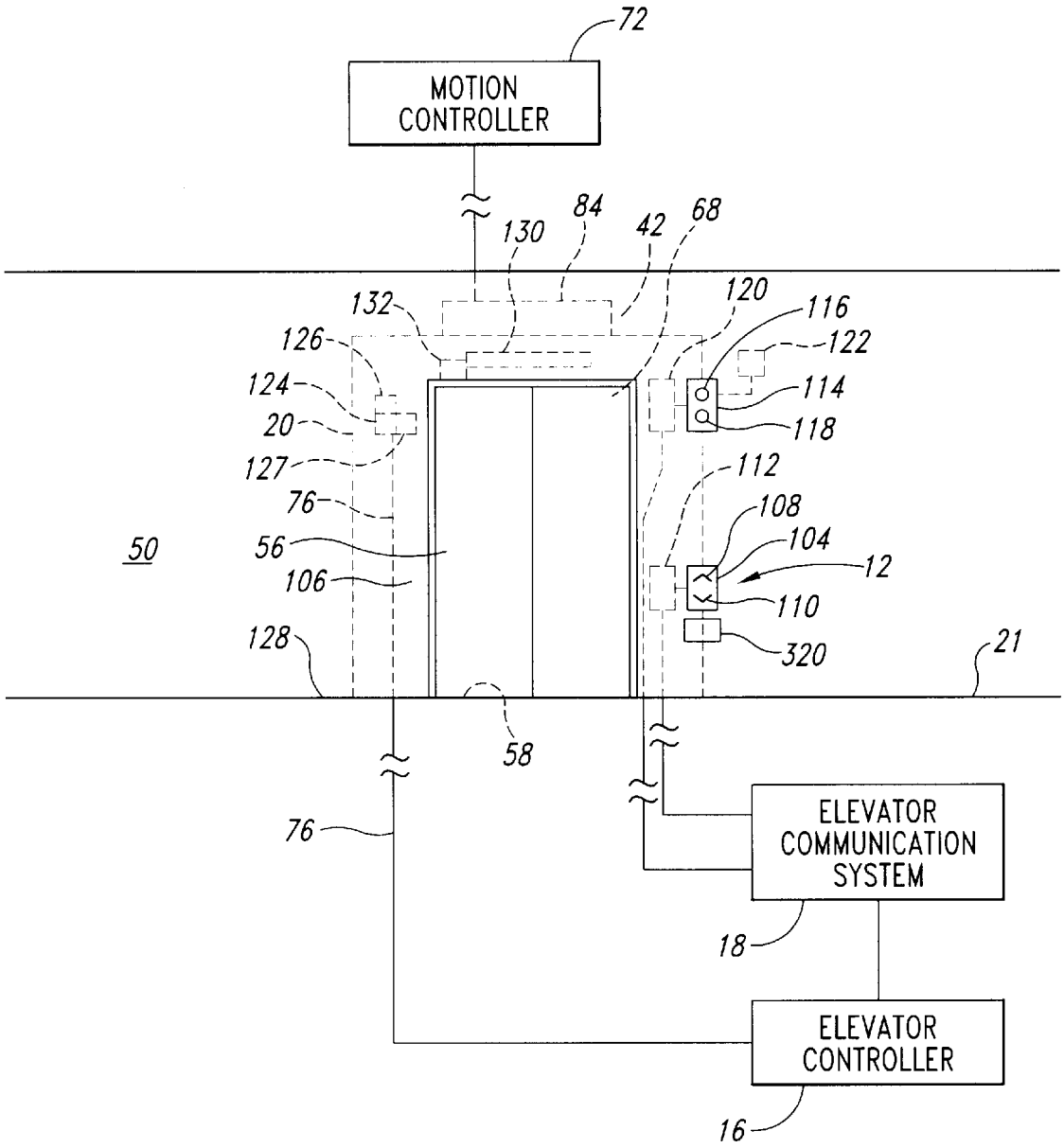
FIG. 4 is an enlarged elevational view of an elevator lobby of the building of FIG. 1 looking toward the hoistway door area and showing the elevator car with broken lines.

As best seen in FIG. 4, the elevator call devices 12 of the exemplary embodiment includes a plurality of hall call stations 104 located in close proximity to the hoistway door assembly 56 in each elevator lobby 106 of the building 2. The hall call station 104 has an up direction call button 108 and a down direction call button 110, each functionally connected to an input/output terminal 112, that is operatively connected to the elevator communication system 18. When an up or down direction call button 108 or 110 is activated, such as when a building occupant desires to leave a particular floor 21, the input/output terminal 112 sends a distinctive signal to the elevator communication system 18 and to the elevator controller 16 to energize the motion controller 72 and move the elevator car 20 to the elevator lobby 106 of the hall call station 104 with the button that has been activated.

A car arrival indicator 114 is located in close proximity to the hoistway door assembly 56 or in close proximity to the elevator car door assembly 68 as best seen in FIG. 4. The car arrival indicator 114 has an up direction light 116 and a down direction light 118, each operatively connected to an input/output terminal 120 which is connected to the elevator communication system 18. When a hall call station 104 is activated and the elevator car 20 arrives at the elevator lobby 106 during normal or non-emergency operations, the elevator controller 16 activates the car arrival indicator 114 showing the car's travel direction by energizing the respective up or down direction light 116 or 118. The elevator controller 16 also energizes an audible car arrival notification device 122 to make distinctive tones for an elevator car traveling upwardly or downwardly.

As best seen in FIG. 4, the location of the elevator car 20 in the hoistway 42 is determined by a position sensor 124 and a position indicator 127 in the hoistway. The position sensor 124 is attached to the elevator car 20 and is connected to an input/output terminal 126, which is operatively connected to the traveling cable 76. The position indicator 127 is attached to the hoistway wall structure 50 within the hoistway shaft 42 near each elevator lobby 106. The position indicator 127 is positioned so that when the position sensor 124 is in direct registry with the position indicator 127, a distinctive signal is sent from the position sensor 124 to the elevator controller 16. The elevator controller 16 then de-energizes the motion controller 72 (FIG. 1) to stop the elevator car's vertical motion and to align the car floor platform 58 in direct registry with a lobby floor 128.

When the car floor platform 58 is stationarily positioned adjacent to the lobby floor 128, the ingress/egress cycle is initiated. The car controller 84 energizes a conventional door motion controller 130 that is operationally connected to the movable car door assembly 68 to move the car door assembly and the hoistway door assembly 56 via an interlock system 132 to an open position, thereby allowing passengers to pass into and out of the elevator car. After a predetermined period of time, such as ten seconds, the elevator controller 16 energizes the door motion controller 130 which moves the hoistway and car door assemblies 56 and 68 to the closed position.

As best seen in FIG. 3, a car door leading edge 134 of the elevator car door assembly 68 is connected to a conventional obstacle sensor, which is connected to the car control communication system 78. The obstacle sensor sends a distinctive signal to the car controller 84, which energizes the door motion controller and automatically reopens the hoistway and car door assemblies 56 and 68 (FIG. 4) if an obstacle, such as a passenger, is in the hoistway entrance as the door assemblies are closing. Accordingly, the obstacle sensor is adapted to prevent the doors from closing and injuring a passenger or the like that is blocking the hoistway and car door assemblies 56 and 68 (FIG. 4) during the door closing cycle.

The car controller 84 is preprogrammed to re-close the hoistway and car door assemblies 56 and 68 (FIG. 4) after a predetermined amount of time, such as two seconds. The car controller 84 is further programmed to stop the reopening operation of the hoistway and car door assemblies 56 and 68 (FIG. 4) after a predetermined number of closing attempts, such as three attempts, at which time the car controller 84 is programmed to activate the audible car notification device 96 and the doors are moved toward the closed position engaging the obstacle. Once the obstacle is removed and the hoistway and car door assemblies 56 and 68 (FIG. 4) are moved to the fully closed position, the car controller 84 de-activates the audible car notification device 96.

A conventional door-closed-sensor is attached to the car door assembly 68 and is operatively connected to the elevator communication system 18 to determine when the car door assembly 68 is in the closed position. Once the car door assembly 68 is in the closed position, the door-closed-sensor provides a distinctive signal to the elevator communication system 18 and the elevator controller 16. The elevator controller 16 then energizes the motion controller 72 which moves the car 20 vertically to other selected floors. As seen in FIG. 4, the hoistway door assembly 56 remains in a closed position until again engaged through the interlock system 132 by the car door assembly 68, thereby preventing accidental access to the hoistway shaft 42.

A conventional load sensor is attached to the motion controller 72 and is operatively connected to the elevator communication system 18 and to the elevator controller 16. The elevator controller 16 is programmed to evaluate the available load capacity of the elevator car 20 by determining a live load weight within the car as established by the load sensor and comparing this weight to the predetermined total live load capacity of the car. As the elevator car 20 responds to the activation of hall call stations 104 within a run, the car will stop at signaling floors until the safe operating capacity of the car has been reached, at which time the elevator car will not respond to additional signaling hall call stations.

When a live load weight exceeds the capacity, the elevator controller 16 activates the audible car notification device 96 and does not permit the motion controller 72 to energize the door motion controller 130. After the load sensor indicates a live load below the safe operating capacity, the elevator controller 16 de-activates the audible car notification device 96 and allows the motion controller 72 to energize the door motion controller 130.

During normal non-emergency operations, the elevator controller 16 is preprogrammed to respond to additional hall call stations 104 that are activated in the traveling direction while the elevator car 20 is traveling to one of the desired floor 21. Once the elevator car 20 has reached the furthest activated hall call station 104, the elevator controller 16 deactivates all activated floor destination buttons and reverses the car's travel direction.

The position and status of each elevator car 20 is monitored by a conventional car position indicator 150, illustrated in FIG. 1, that is located in close proximity to the fire alarm panel 26. The car position indicator 150 is connected in a conventional manner to the elevator controller 16 via the elevator communication system 18. The car position indicator 150 provides a visual indication showing the position, direction of travel and operational status of each elevator car 20.

Fire and Smoke Detection System

As described above and best seen in FIG. 1, the smoke and fire detection/alarm system 8 includes a plurality of remote smoke/fire detectors 22. The smoke/fire detectors 22 are strategically located throughout each floor 21 of the building in accordance with local building and fire codes. The detectors 22 are functional to detect the presence of combustion byproducts, such as smoke or toxic fumes. Each detector 22 is operatively connected to the smoke and fire detection/alarm communication system 28. Each individual detector 22 is programmed or otherwise configured to initiate and send a distinctive, location-identifying alarm signal to the fire alarm panel 26 when smoke or another combustion byproduct is detected.

The fire alarm panel 26 is programmed to identify the distinctive signal received from each detector 22. The fire alarm panel 26 is further programmed with the location, type and operating parameters of each detector 22, so as to determine where and which detector in the building was activated upon detecting smoke or the like.

The fire alarm panel 26 is also operatively connected to the detection/alarm communication system 28 and is adapted to control or activate conventional audible/visual building alarms. The detection/alarm communication system 28 also operates a conventional public address-type annunciation system, and a fire department notifier, such as an automatic dialer connected to an outside telephone line, and other conventional smoke and fire detection/alarm system signal responsive devices.

The fire alarm panel 26 is also operatively connected to self-closing fire doors on each floor 21 that close to separate the respective elevator lobby 106 from the remainder of the building. The fire alarm panel 26 is also operatively connected in a conventional manner to control air handling equipment in the building to provide positive air pressure within the elevator lobby 106 and the elevator hoistway shaft 42 to keep the lobby and hoistway shaft clear of smoke.

The detectors 22, best seen in FIG. 1, are strategically placed throughout the building 2 with a minimum of one per floor. Lobby smoke detectors 174 are also strategically located throughout the building 2, with a minimum of one in each elevator lobby 106. An elevator car smoke detector 176, best seen in FIG. 3, is mounted on the elevator car 20 and is operatively connected to the smoke and fire detection/alarm communication system 28 by the traveling cable 76.

As best seen in FIG. 1, a plurality of hoistway smoke detectors 178 are located within the hoistway shaft 42. An upper hoistway smoke detector 180 is connected to the wall structure 50 near the hoistway shaft's upper limit 44. A lower hoistway smoke detector 182 is connected to the wall structure 50 near the hoistway shaft's lower limit 46. An intermediate hoistway smoke detector 184 is connected to the wall structure 50 near the hoistway shaft's midpoint 48. When a detector 22 is activated upon detecting smoke or the like, the detector sends a distinctive signal to the fire alarm panel 26 that allows the fire alarm panel to determine where the signaling detector is located.

The fire alarm panel 26 also has an elevator recall switch 186 that is connected to the elevator controller 16 via the elevator communication system 18, as described above. The elevator recall switch 186 may be automatically activated, such as when a detector 22 is activated. The elevator recall switch 186 may also be manually activated, such as during a non-fire emergency. The elevator recall switch 186 provides a signal to the elevator controller 16, which de-activates all hall call stations 104 and destination buttons 86 in all elevator cars 20 and energizes the motion controller 72 to move all elevator cars to a predesignated recall floor 188, typically established as the ground floor with a ready exit from the building 2.

A recall floor smoke detector 190 is strategically located at the predesignated recall floor 188 and connected to the elevator communication system 18, which is operatively connected to the elevator controller 16, as described above. When the recall floor smoke detector 190 detects smoke, a distinctive signal is sent to the elevator controller 16 which energizes the motion controller 72 to move the elevator cars 20 to a predesignated alternate recall floor 192, typically established as a floor located two floors above the ground floor.

The Control Protocol Interface

Figure 5A:
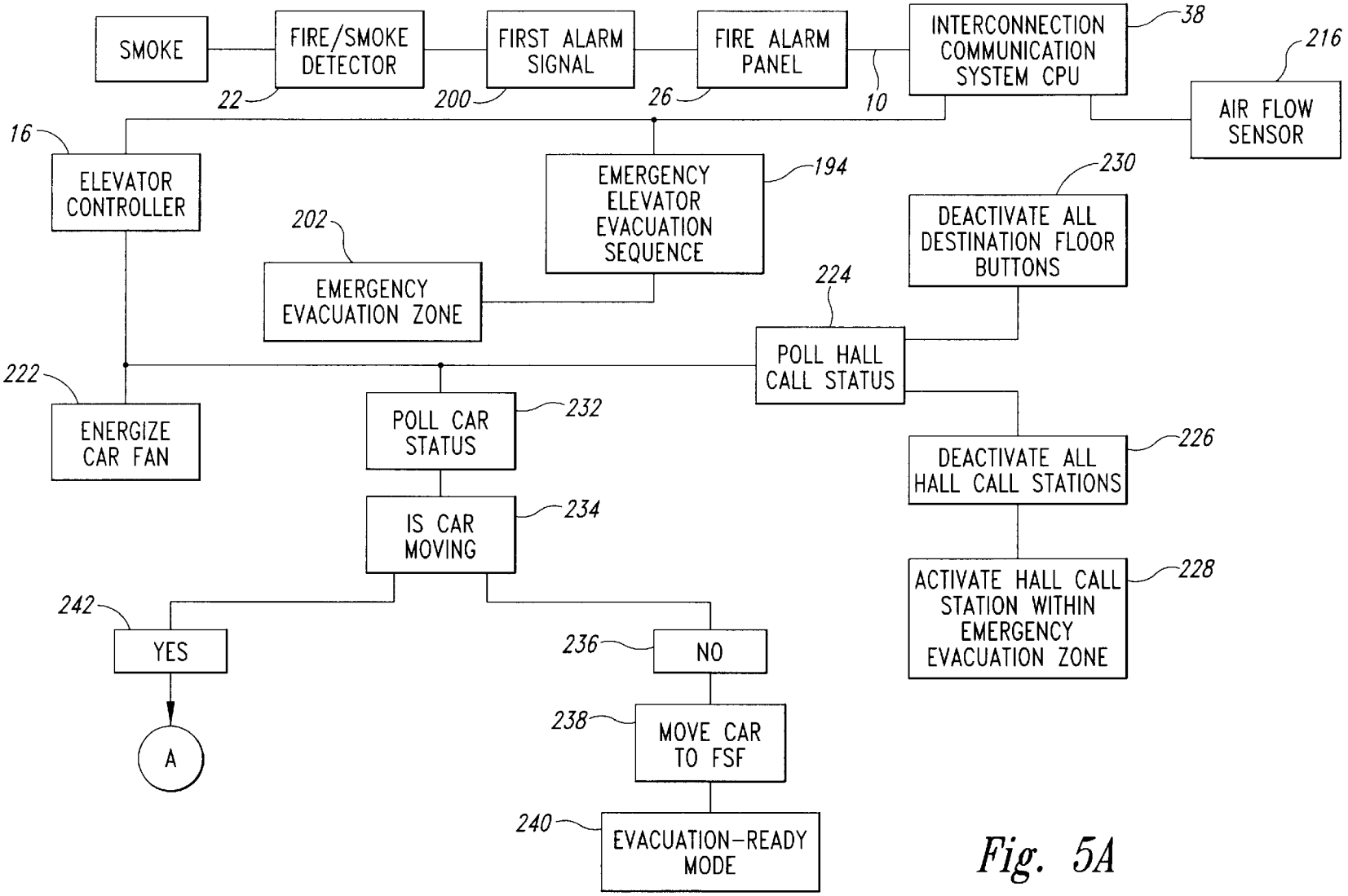
FIG. 5 is a partial schematic flow chart illustrating an exemplary emergency evacuation sequence upon activation of a remote smoke detector in accordance with one embodiment of the present invention.
Figure 5B:
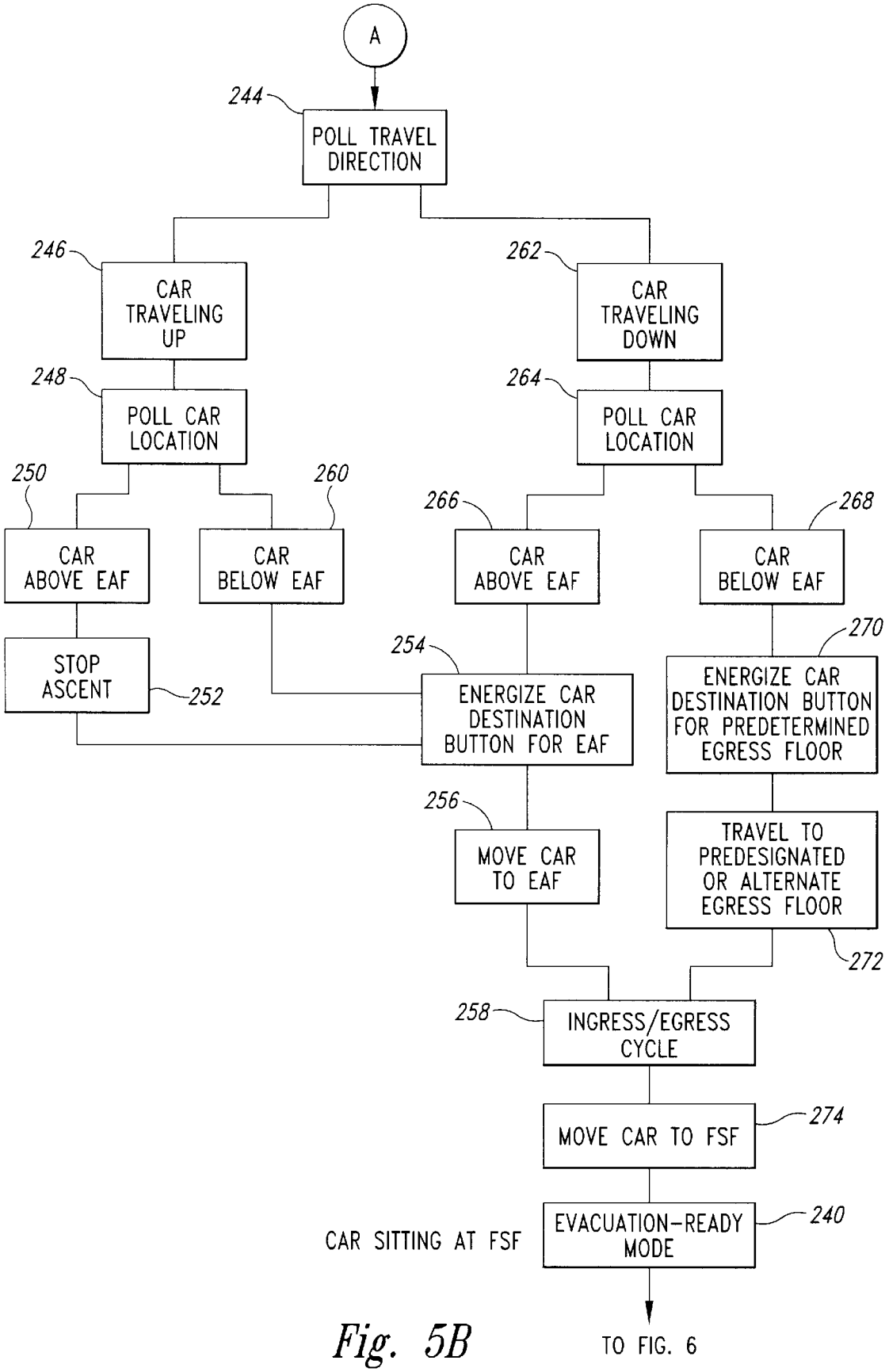

During non-emergency normal operation, the smoke and fire detection/alarm system 8 and the interconnection system 10 remains in the normal mode, wherein the elevator system 6 operates in a conventional non-emergency manner. During this normal operation, the fire alarm panel 26 polls and monitors the smoke/fire detectors 22. As best seen in FIG. 5, in the event of a building fire, smoke or heat from the fire is detected by one or more detectors 22, the detector sends a distinctive first alarm signal 200 to the fire alarm panel 26. The first alarm signal 200 is transmitted by the fire alarm panel 26 through the interconnection communication system 10 to the CPU 38 and translated by the BACnet protocol language, thereby initiating an emergency elevator evacuation sequence 194.

Figure 2A:
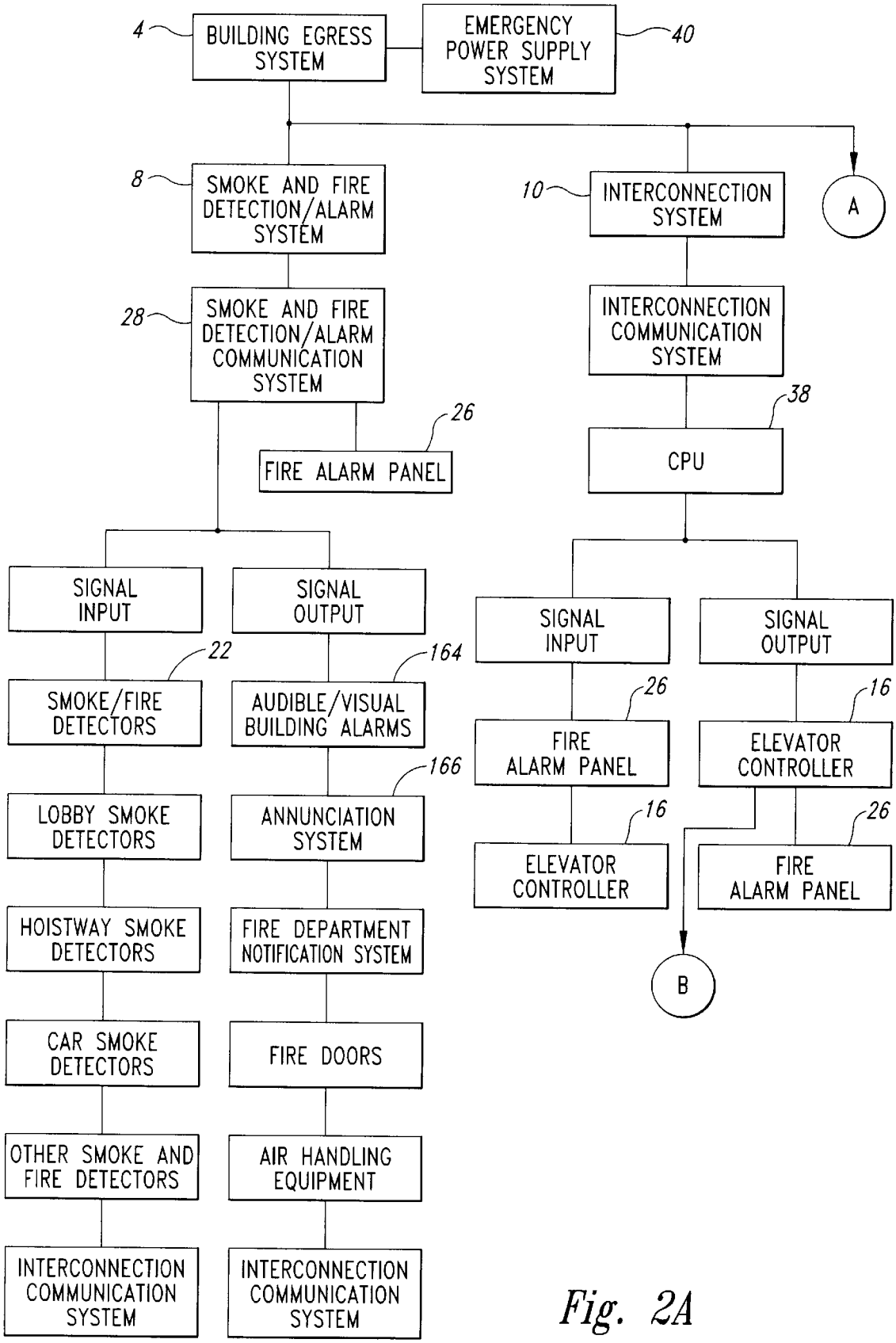
FIG. 2 is a schematic representation showing an exemplary building egress system of the building egress system of FIG. 1.
Figure 2B:
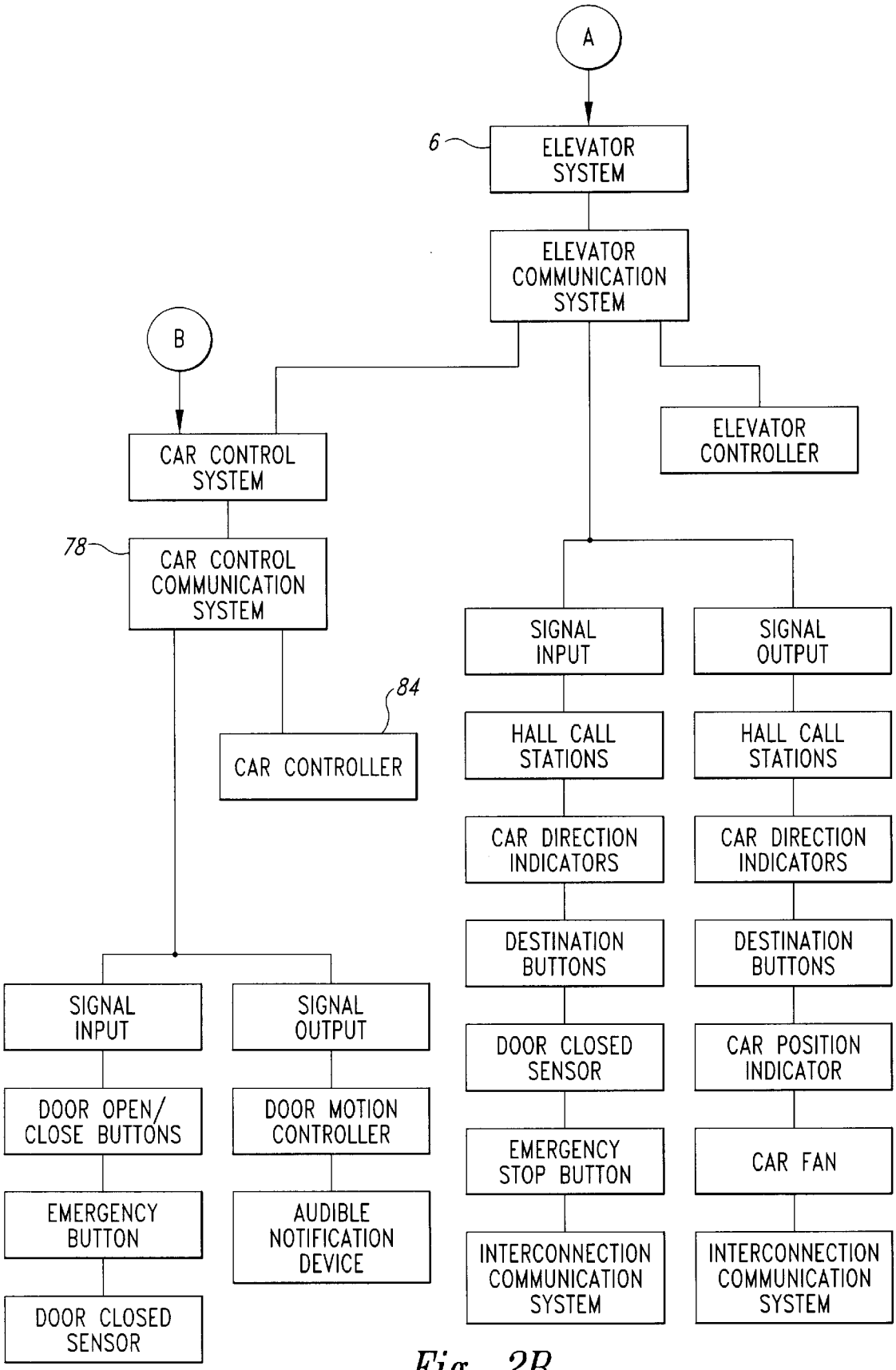

During the fire or other building emergency, the components of the building egress system 4 of the exemplary embodiment, as described herein and schematically illustrated in FIG. 2, work together in an emergency elevator evacuation sequence that utilizes the one or more elevator cars 20 to evacuate selected portions of the building 2. The interconnection system's CPU 38 is engineered and programmed to initiate a preprogrammed emergency elevator evacuation sequence. During the evacuation sequence, the CPU 38 sends distinctive output signals to the elevator controller 16 in response to distinctive input signals received from the fire alarm panel 26. Upon receiving the output signals, the elevator controller 16 strategically positions one or more elevator cars 20 at selected floors to evacuate portions of the building 2. The CPU 38 also sends distinctive output signals to the fire alarm panel 26 in response to distinctive input signals initiated by the elevator controller 16, thereby notifying the fire alarm panel 26 of the status of all elevator cars 20. The emergency evacuation sequence is then initiated.

The Emergency Evacuation Sequence

The emergency elevator evacuation sequence establishes an emergency evacuation zone 202, as best seen in FIG. 1, encompassing a four floor area around a first signaling floor (FSF) 206 on which a first signaling remote smoke/fire detector 204 of the detectors 22 is located. The first signaling floor 206 is assigned by the CPU 38 a first priority during the evacuation of the emergency evacuation zone 202. The emergency evacuation zone 202 also includes a second evacuation priority floor 208 located one floor above the first signaling floor 206, a third evacuation priority floor 210 located one floor below the first signaling floor, and a fourth priority evacuation floor 212 located two floors above the first signaling floor. The emergency evacuation zone 202 also includes an evacuation assistance floor 214 located four floors below the first signaling floor 206. The floors 21 outside the emergency evacuation zone 202 are defined as non-emergency floors 215. If the first signaling floor 206 is within the first seven floors 21 above the ground floor, the evacuation assistance floor (EAF) 214 is established as the predesignated recall floor 188 (usually the ground floor).

The configuration of the emergency zone 202 may be changed depending upon air flow direction in the hoistway shaft 42. In the exemplary embodiment, an air flow sensing device 216, shown in FIG. 1, is mounted in the hoistway shaft 42, and is operatively connected to the CPU 38 of the interconnection system operator 34. The air flow sensing device 216 identifies the direction of air flow in the hoistway shaft 42. The air flow sensing device 216 has an upper sensor 218 connected to the wall structure 50 of the hoistway shaft 42 near the upper limit 44 thereof and a lower sensor 220 connected to the wall structure 50 of the hoistway shaft 42 near the lower limit 46 thereof, each operationally connected to the interconnection communication system 36.

If the airflow is upward, so smoke within the hoistway shaft will likewise move upwardly toward the upper floors, the emergency evacuation zone 202 is as described above. If, however, the airflow is downward, so smoke would travel downwardly toward lower floors, the CPU 38 is programmed to reverse the order of floors in the emergency evacuation zone 202 described above. Accordingly, the evacuation assistance floor 214 is located four floors above the first signaling floor 206. The second evacuation priority floor 208 is one floor below the first signaling floor 206, the third evacuation priority floor 210 is two floors below the first signaling floor, and the fourth evacuation priority floor is one floor above the first signaling floor.

The emergency elevator evacuation sequence 194, therefore, is functional to conduct emergency evacuation via the elevator cars 20 in a compact six floor zone. The evacuation time is therefore relative to elevator travel within this six floor zone and not relative to elevator car travel within the entire height of the building 2.

When Smoke is Detected

When one of the detectors 22 detects smoke or the like, as best schematically illustrated in FIG. 5, the detector sends a first alarm signal 200 to the interconnection system operator's CPU 38, and the CPU initiates the emergency elevator evacuation sequence 194. The CPU 38 further sends a distinctive signal to the elevator controller 16 which energizes a car fan 222 (see FIG. 3) that moves air from the elevator hoistway shaft 42 into the elevator car 20. In step 224, the elevator controller polls the hall call stations 104 of the floors in the emergency evacuation zone 202, and in step 226, deactivates all hall call stations of floors outside of the emergency evacuation zone. In step 228, the elevator controller further energizes the down direction light 114 in the hall call stations 104 located within the emergency evacuated zone 202 to blink in a continuous intermittent manner. In step 230, the elevator controller 16 further deactivates all destination floor buttons 86 in the elevator car 20.

The elevator controller 16 also polls in step 232 the car status and determines in step 234 if the elevator car 20 is moving. If the elevator car is not moving, in step 236 the elevator controller 16 sends a distinctive signal to the motion controller 72 which in step 238 moves the elevator car to the first signaling floor 206. The elevator controller 16 initiates an evacuation-ready mode in step 240 in which the hoistway and car door assemblies 56 and 68 are moved to the open position, the down direction light is intermittently blinked, and the car arrival notification device 122 is energized to ring in a continuous intermittent manner.

If the elevator car 20 is moving, in step 242 the elevator controller 16 polls in step 244 the car's direction of travel. If the car travel direction is upwardly, in step 246 the elevator controller 16 polls in step 248 the elevator car's location relative to the evacuation assistance floor 214. If in step 250 the elevator car is above the evacuation assistance floor 214, the elevator controller stops the car's ascent in step 252, in step 254 energizes the car destination button 86 for the evacuation assistance floor 214, and in step 256 moves the car to the evacuation assistance floor. The elevator controller 16 then in step 258 initiates the ingress/egress cycle, as described above. If the elevator car 20 is traveling upwardly in step 246 and is below the evacuation assistance floor in step 260, the elevator controller 16 in step 254 energizes the car destination button 86 for the evacuation assistance floor 214, in step 256 moves the car to the evacuation assistance floor, and in step 258 initiates the ingress/egress cycle.

If in step 262 the elevator car 20 is traveling downwardly, in step 264 the elevator controller 16 polls the location of the downwardly traveling car. If in step 266 the elevator car is above the evacuation assistance floor, in step 254 the elevator controller 16 energizes the car destination button 86 for the evacuation assistance floor 214, in step 256 moves the car to the evacuation assistance floor, and in step 258 initiates the ingress/egress cycle.

If in step 262 the elevator car 20 is traveling downwardly and in step 268 is below the evacuation assistance floor 214, in step 270 the elevator controller 16 energizes the car destination button 86 for the evacuation assistance floor 214, in step 272 moves the car to the evacuation assistance floor or a designated alternate floor, and in step 258 initiates the ingress/egress cycle. Once the ingress/egress cycle is completed, and the occupants move out of the car to the evacuation assistance floor 214, in step 274 the elevator controller moves the car to the first signaling floor 206 and in step 240 the car controller initiates the evacuation-ready mode.

The Evacuation-Ready Mode at the First Signaling Floor

Figure 6:
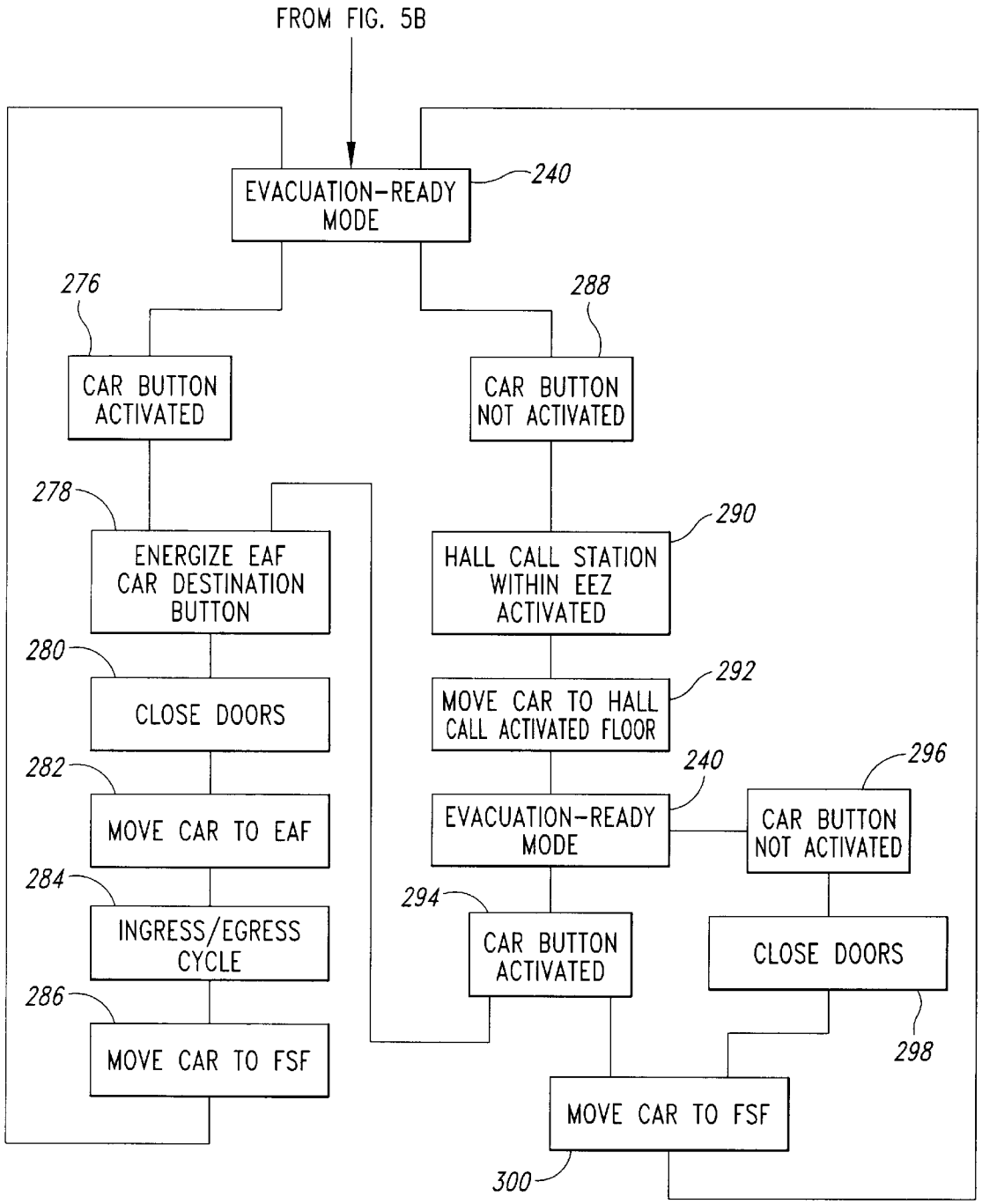
FIG. 6 is a partial schematic flow chart illustrating the exemplary emergency evacuation mode of the emergency evacuation sequence of FIG. 5.

During the evacuation-ready mode, step 240 of the emergency elevator evacuation sequence, as best illustrated schematically in FIG. 6, the elevator car is positioned at the first signaling floor with the doors open awaiting the arrival of passengers. When in step 276 a passenger enters the car and activates any car button 86, 88, or 90, the elevator controller 16 in step 278 energizes the car destination button for the evacuation assistance floor 214. The elevator controller will also automatically energize the car destination button for the evacuation assistance floor when the car's load sensor detects additional weight in the elevator car, such as when a passenger enters the car. In step 280 the elevator controller 16 closes the hoistway and car door assemblies 56 and 68, in step 282 moves the elevator car from the first signaling floor 206 to the evacuation assistance floor 214, and in step 284 initiates the ingress/egress cycle to allow the passengers to exit from the car. The elevator controller in step 286 then moves the elevator car back to the first signaling floor 206 and in step 240 restarts the evacuation-ready mode of step 240.

The elevator car 20 remains at the first signaling floor 206 for a predetermined amount of time, such as thirty seconds, in the evacuation-ready mode. If in step 288 a car button 86, 88, or 90 is not manually or automatically activated within the predetermined amount of time, the elevator car is then available to respond to the activation of hall call stations 104 on other floors within the emergency evacuation zone 202. When in step 290 a hall call station 104 is activated on another floor within the emergency evacuation zone 202, in step 292 the elevator controller 16 closes the hoistway and car door assemblies 56 and 68 and moves the car to the floor on which the hall call station was activated. The elevator controller then initiates the evacuation-ready mode of step 240, as described above. If hall call stations 104 are activated on more than one floor in the emergency evacuation zone 202, the elevator controller 16 moves the elevator car to the floor having the highest priority of the second evacuation priority floor 208, the third evacuation priority floor 210 or the fourth priority evacuation floor 212.

If in step 294 a passenger activates a car destination button 86 or if the load sensor detects additional weight in the elevator car within the predetermined amount of time, in step 278 the elevator controller 16 energizes the car destination button 86 for the evacuation assistance floor 214. The elevator controller in step 280 closes the hoistway and car door assemblies 56 and 68, in step 282 moves the elevator car to the evacuation assistance floor 214, and in step 284 initiates the ingress/egress cycle. The elevator controller in step 240 then moves the elevator car 20 back to the first signaling floor 206 and initiates the evacuation-ready mode.

If in step 296 the elevator car is in the evacuation-ready mode of step 240 on a floor other than the first signaling floor 206 and a destination car button 86 is not manually or automatically activated within the predetermined amount of time, the elevator controller 16 in step 298 closes the hoistway and car doors 56 and 68, in step 300 moves the car back to the first signaling floor 206, opens the door assemblies, and initiates the evacuation-ready mode of step 240.

The elevator car remains in step 288 in the evacuation-ready mode of step 240 on the first signaling floor 206 until a car button 86, 88, or 90 is activated, or in step 290 the load sensor detects additional weight within the car, or a hall call station 104 within the emergency evacuation zone 202 is activated.

In the exemplary embodiment, the elevator controller 16 is programmed to respond to only one hall call station 104 activation within each trip cycle to allow passengers safe egress onto the evacuation assistance floor 214. The elevator controller is further programmed to respond to the first signaling floor 206 as the highest priority and then follow the prioritization of evacuation floors as described above. The evacuation of building occupants from the emergency evacuation zone 202 to the evacuation assistance floor 214 is thereby quickly, efficiently and safely accomplished.

As the Smoke Migrates

Figure 7:
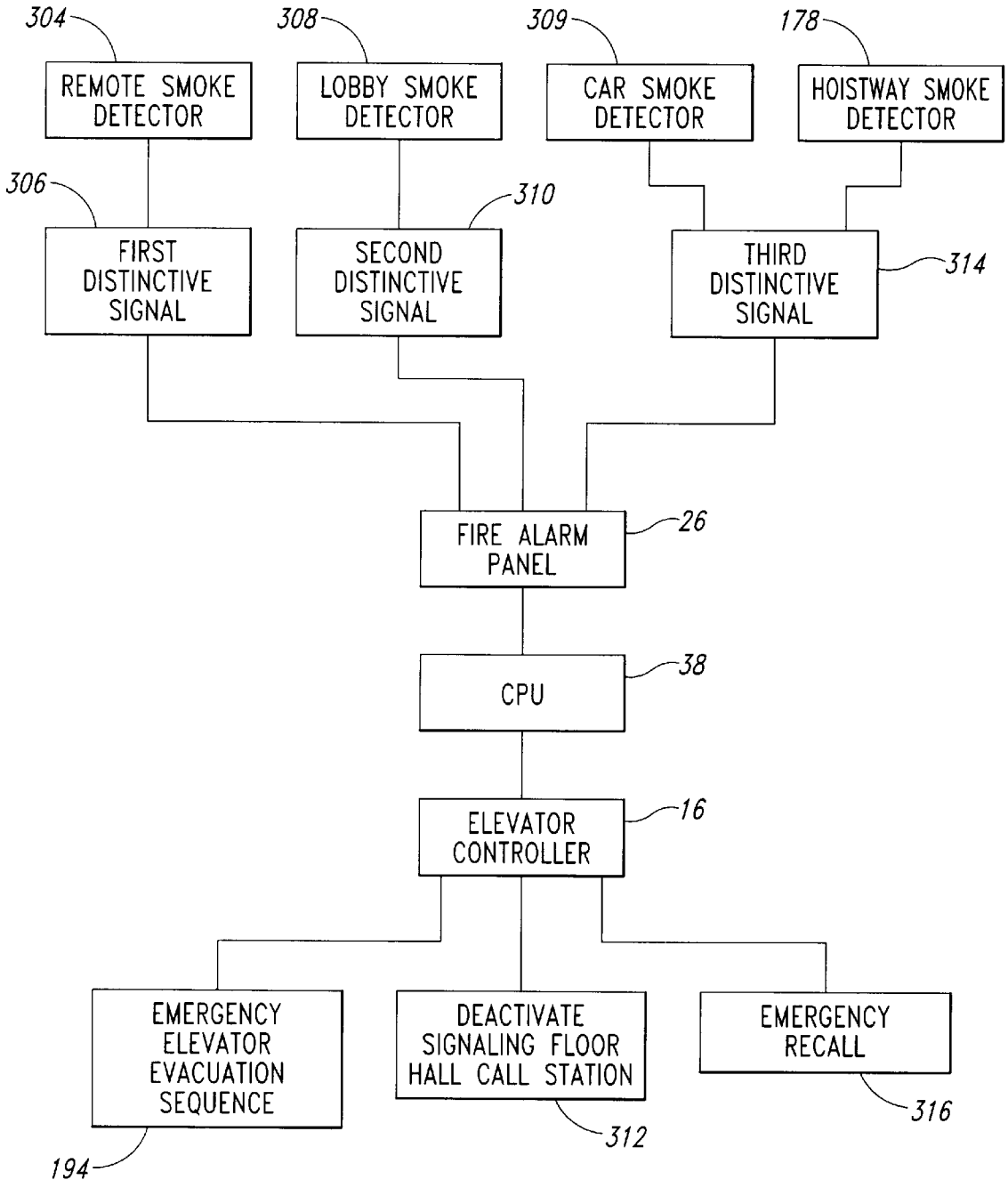
FIG. 7 is a schematic flow chart illustrating an exemplary emergency evacuation sequence during further developed stages of a building fire in accordance with one embodiment of the present invention.

As schematically illustrated in FIG. 7, in step 304 upon the detection of smoke by one of the remote smoke/fire detectors 22 that is not located in that floor's elevator lobby, the remote detector in step 306 sends a first distinctive detection signal to the fire alarm panel 26. The interconnection system operator's CPU 38 receives a signal from the fire alarm panel 26, translates the signal and sends a signal to the elevator controller 16. The elevator controller 16 then initiates the emergency elevator evacuation sequence of step 194, as described above with reference to FIG. 5. When in step 30 the smoke/fire detector 22 located in the elevator lobby of any floor in the emergency evacuation zone 202 is activated, in step 310 the lobby smoke/fire detector sends a second distinctive detection signal to the fire alarm panel 26. A signal is sent to the CPU 38 where it is translated and sent to the elevator controller 16. The elevator controller 16 in step 312 then deactivates the hall call station 104 on the floor where the lobby smoke/fire detector was activated, thereby preventing the car door assemblies 68 from opening at that floor. As a result, the occupants on that floor must use the stairway for evacuation to the evacuation assistance floor 214. In one embodiment, audible recorded instructions are played over the recorded-voice enunciator system so as to provide instructions to occupants to proceed to the stairwell for evacuation, because the elevators are out of service.

When in step 309, the car smoke detector 176 detects smoke or in step 178 the hoistway smoke detector 178 detects smoke, in step 314 that smoke detector sends a third distinctive detection signal to the fire alarm panel 26, which sends the signal to the interconnection system operator's CPU 38. The CPU 38 translates the signal and sends it to the elevator controller 16. The elevator controller 16 in step 316 then initiates an emergency recall sequence in which all hall call stations 104 and car destination buttons 86 are deactivated and all cars are moved and parked at the predesignated recall floor 188. The elevator controller then powers down, thereby taking the car out of service. Audible instructions are played over the recorded-voice enunciator on the floors of the emergency evacuation zone 202 to proceed to the stairwells for evacuation, because the elevators are out of service. All remaining building occupants must await the arrival of the fire department for rescue or use the building exit stairways for evacuation.

In the exemplary embodiment, the car controller 84 (see FIG. 3) is equipped with an emergency battery, having the capacity to open and close the hoistway and car door assemblies 56 and 68 if the emergency power supply 40 is interrupted. When building or emergency power is not available, the emergency battery energizes the door motion controller 130 to move the hoistway and car door assemblies 56 and 68 to the closed position. The car controller 84 then sends an alarm signal to the fire alarm panel 26, signaling a stranded elevator car.

In the exemplary embodiment, a sign placard such as the placard 320 illustrated in FIG. 8, is located in each elevator car and in each elevator lobby, as shown in FIG. 3. The placard provides instructions to building occupants regarding emergency evacuation via the elevators. The placard 320 also provides information to the occupants about using the stairway for evacuation.

The exemplary embodiment of the building egress system 4 of the present invention provides an increased level of protection for elevator passengers traveling within the hoistway shaft 42 and provides an evacuating sequence to evacuate the building occupants in a safe manner during an emergency, such as a building fire. Further modifications and improvements within the scope of the present invention can be made to the building egress system for particular building configurations, including programming the interconnection system 10 to measure the time between the detection of smoke or the like at individual smoke/fire detectors 22, so as to monitor and anticipate the speed at which the smoke and fire is spreading within the building.

Additional Fire Floors

If the building's elevator system 6 has more than one elevator car 20 and if smoke is detected on a floor in the emergency evacuation zone 202, a second emergency evacuation zone is established by the interconnection system operator's CPU 38 in the manner described above. The evacuation assistance floor 214 remains as designated and described above. Half of the available elevator cars are dedicated to the emergency evacuation of the second emergency evacuation zone. If smoke is detected on another floor outside the emergency evacuation zone 202, another emergency evacuation zone is established in the manner described above and a second evacuation assistance floor is designated. In the event a third emergency evacuation zone is established, one half of the available cars are dedicated to the first emergency evacuation zone, one quarter of the available elevator cars are dedicated to the second emergency evacuation zone, and one quarter of the available elevator cars are dedicated to the third emergency evacuation zone. The emergency evacuation sequence is then completed in each evacuation zone with the available elevator cars for that evacuation zone.

Reprogramming by the Fire Department

In the exemplary embodiment, the interconnection system operator's CPU 38 is reprogrammable by fire department personnel to control the function of the elevator cars 20 during a building emergency. Visual indication of the status, mode and location of all cars is provided at the car position indicator 150 adjacent to the fire alarm panel 26 so the fire department has a full understanding of the status of each elevator car 20 prior to overriding the standard programming. Any number of elevators may be recalled to the predesignated egress floor 188. The fire department can then manually control and use the elevator cars to evacuate people from the emergency evacuation zone 202, from the evacuation assistance floor 214, or from the remainder of the building 2. The fire department can also manually control the elevator cars to stage men and equipment at selected floors 21 relative to the fire floor. The fire department can also establish additional emergency evacuation zones as well as altering the priority of evacuation floors in accordance with a modified evacuation procedure.

Although specific embodiments of, and examples for, the present invention have been described above for the purposes of illustration, various modifications can be made without departing from the spirit and scope of the invention, as will be evident to those skilled in the relevant art. For example, the size, spacing and priority of floors in the emergency evacuation zone can be modified to provide a larger emergency evacuation zone, such as when a larger number of elevator cars are available for the emergency evacuation procedure.

In general, in the following claims the terms used should not be construed to limit the invention to the specific embodiments disclosed in the specification and claims, but should be construed to include all emergency evacuation systems and methods of evacuation in accordance with the claims. Accordingly, the invention is not limited by the disclosure, but instead its scope is to be determined from the following claims.

I claim:

1. A multi-floor building, comprising:

a plurality of floors, including a building exit floor;

a plurality of detectors, at least one of the detectors being located on a respective one of the floors, each detector being positioned to detect a selected emergency condition, the detector that detects the emergency condition being a signaling detector that generates a detector signal upon detecting the emergency condition; and a vertical transportation system usable for moving building occupants between selected floors during an emergency condition, the vertical transportation system including:

a transport unit sized to hold at least one building occupant and vertically movable in the building, the transport unit being positionable to locations adjacent to selected floors in the building;

a transport controller coupled to the transport unit to move the transport unit to the locations adjacent to the selected floors; and a control unit coupled to the transport controller to send a selected control signal to the transport controller to move the transport unit to a selected one of the locations adjacent to the selected floors, the control unit being coupled to the detectors to receive the detector signal from the signaling detector, the control unit defining a floor where the signaling detector is located as a signaling floor, defining an evacuation assistance floor that is different than the building exit floor and that is spaced apart from the signaling floor, and defining floors considered to be non-emergency floors where the transport unit will be restricted from receiving building occupants during the emergency condition while the building occupants are being evacuated from the signaling floor, the control unit being configured to send the control signal to the transport controller to cause movement of the transport unit between the signaling floor and the evacuation assistance floor and not the non-emergency floors during the emergency condition to evacuate building occupants from the signaling floor to the evacuation assistance floor during the emergency condition.

2. The building of claim 1 wherein the control unit is configured to establish an evacuation zone that includes the signaling floor as a first priority evacuation floor and a second priority evacuation floor one floor away from the signaling floor, the control unit determining which of the first and second priority evacuation floors has a highest priority and controlling the transport controller to move the transport unit to evacuate the highest priority evacuation floor first.

3. The building of claim 2 wherein the first priority evacuation floor is a higher priority evacuation floor than the second priority evacuation floor.

4. The building of claim 2 wherein the second priority evacuation floor is one floor away from the signaling floor in a first direction, and the evacuation zone has a third priority evacuation floor located one floor away from the signaling floor in a second direction, and the control unit being configured to send the control signal to the transport controller to move the transport unit between the first, second and third priority evacuation floors, and the evacuation assistance floor to evacuate building occupants from first, second, and third priority evacuation floors to the evacuation assistance floor.

5. The building of claim 1 wherein the signaling floor is a first priority evacuation floor, and the building further includes a second priority evacuation floor located one floor above the signaling floor, a third priority evacuation floor located one floor below the signaling floor, and a fourth priority evacuation floor located two floors above the signaling floor, the control unit being configured to send the control signal to the transport controller to move the transport unit between the first, second, third, and fourth priority evacuation floors, and the evacuation assistance floor to evacuate building occupants from the first, second, third, and fourth priority evacuation floors to the evacuation assistance floor.

6. The building of claim 5 wherein the control unit is configured to send the control signal to the transport controller to evacuate building occupants from the floors with the higher priority before floors with a lower priority, and wherein the first priority evacuation floor is the highest priority evacuation floor, the second priority evacuation floor is the second highest priority evacuation floor, the third priority evacuation floor is the third highest priority evacuation floor, and the fourth priority evacuation floor is the fourth highest priority evacuation floor.

7. The building of claim 1 wherein the signaling floor is a first priority evacuation floor, and the building includes a second priority evacuation floor located one floor below the signaling floor, a third priority evacuation floor located one floor above the signaling floor, and a fourth priority evacuation floor located two floors below the signaling floor, the control unit being configured to send control signals to the transport controller to move the transport unit between the first, second, third and fourth priority evacuation floors, and the evacuation assistance floor to evacuate building occupants from the first, second, third, and fourth priority evacuation floors to the evacuation assistance floor.

8. The building of claim 1 wherein the transport unit is an elevator car, and the transport controller is an elevator controller.

9. The building of claim 1 wherein the evacuation assistance floor is located at least four floors away from the signaling floor.

10. The building of claim 1 wherein the detectors are smoke detectors.

11. The building of claim 1, further including a fire alarm panel to which the detectors are operatively connected, and the control unit is an interconnection device that communicates with the detectors and the transport controller, the interconnection device having a central processing unit that establishes an emergency evacuation zone upon detection of the emergency condition that includes the signaling floor and at least one additional floor from which the transport unit will receive building occupants during the emergency condition for evacuation to the evacuation assistance floor.

12. The building of claim 1, further including a hoistway detector that detects the emergency condition if located in a hoistway within which the transportation unit is vertically movable, the hoistway detector being coupled to the control unit and adapted to send a hoistway detection signal to the control unit when the hoistway detector detects the emergency condition in the hoistway, the control unit sending a deactivation signal to the transport controller to take the transport unit out of service in response to the control unit receiving the hoistway detection signal.

13. The building of claim 12 wherein the transport controller moves the transportation unit to a parked, out-of-service position in response to the transport controller receives the deactivation signal.

14. The building of claim 1 wherein the vertical transportation system includes a hoistway within which the transport unit is movably positioned, and a transport detector mounted on the transport unit, the transport detector being operatively connected to the control unit and adapted to send an emergency detection signal to the control unit when the transport detector detects the emergency condition, the control unit sending a deactivation signal to the transport controller to deactivate the transport unit in response to the control unit receiving the emergency detection signal, the transport controller moving the transport unit to a parked, out-of-service position in the hoistway in response to the deactivation signal.

15. The building of claim 1 wherein a plurality of the floors each have a floor lobby, and each of the floor lobbies has a floor lobby detector, the floor lobby detectors being coupled to the control unit, each floor lobby detector providing an emergency signal to the control unit when the floor lobby detector detects the emergency condition in the floor lobby, the control unit in response thereto sending a by-pass signal to the transport controller that prevents the transport unit from being used to evacuate building occupants from the floor with the floor lobby detector which detected the emergency condition.

16. A vertical transportation system in a multi-floor building usable for evacuation of a portion of the building during an emergency condition, the building having a plurality of floors including a building exit floor, and combustion detectors on the floors, each the combustion detectors adapted to detect a combustion by-product and to generate a detector signal when a combustion by-product is detected, the combustion detector that generates a detector signal being a signaling detector, comprising:

an elevator car positionable in the hoistway to locations adjacent to selected floors;

an elevator controller coupled to the elevator car to move the elevator car to the locations adjacent to the selected floors, the elevator controller receiving selected floor control signals; and a control unit coupled to the elevator controller to send a control signal to the elevator controller to move the elevator car to a selected one of the locations adjacent to the selected floors, the control unit being coupled to the combustion detectors to receive the detector signal from the signaling detector, the control unit being configured to define an evacuation zone in the building upon receiving the detector signal from the signaling detector, the control unit identifying the floor where the signaling detector is located as a signaling floor, the control unit defining the evacuation zone as including at least the signaling floor and an evacuation assistance floor that is not the building exit floor and that is spaced apart from the signaling floor, and defining floors considered to be non-emergency floors other than the evacuation assistance floor where the elevator car will be restricted from receiving building occupants during the emergency condition while the building occupants are being evacuated from the signaling floor, the control unit being configured to send the control signal to the elevator controller when the evacuation zone is established to cause movement of the elevator car between the floors of the evacuation zone and not the non-emergency floors during the emergency condition to evacuate building occupants from the signaling floor to the evacuation assistance floor during the emergency condition.

17. The vertical transportation system of claim 16 wherein the control unit establishes the evacuation zone with the signaling floor as a highest priority floor and another evacuation floor as a second highest priority floor, the control unit controlling the elevator controller to move the elevator car to evacuate the highest priority floor before the second highest priority floor.

18. The vertical transportation system of claim 16 wherein the signaling floor is a first priority evacuation floor and the building includes a second priority evacuation floor located one floor above the signaling floor, and a third priority evacuation floor located one floor below the signaling floor, the control unit being configured to define the evacuation zone as including the first, second and third priority evacuation floors in addition to the evacuation assistance floor, and configured to send the control signal to the elevator controller to cause movement of the elevator car between the first, second, and third priority evacuation floors and the evacuation assistance floor during the emergency condition to evacuate building occupants from the first, second and third priority evacuation floors to the evacuation assistance floor.

19. The vertical transportation system of claim 16 wherein the signaling floor is a first priority evacuation floor and the building includes a second priority evacuation floor located one floor above the signaling floor, a third priority evacuation floor located one floor below the signaling floor, and a fourth priority evacuation assistance floor located two floors above the signaling floor, the control unit being configured to define the evacuation zone as including the first, second, third and fourth priority evacuation floors in addition to the evacuation assistance floor and configured to send the control signal to the elevator controller to cause movement of the elevator car between the first, second, third and fourth priority evacuation floors and the evacuation assistance floor during the emergency condition to evacuate building occupants from the first, second, third and fourth priority evacuation floors to the evacuation assistance floor.

20. The vertical transportation system of claim 19 wherein the first priority evacuation floor is the first highest priority floor, the second priority evacuation floor is the second highest priority floor, the third priority evacuation floor is the third highest priority floor, and the fourth priority evacuation floor is the fourth highest priority floor, the control unit being configured to send the control signal to the elevator controller to evacuate building occupants from floors with a higher priority before floors with a lower priority.

21. The vertical transportation system of claim 16 wherein the control unit defines the evacuation assistance floor as being located at least four floors away from the signaling floor.

22. The vertical transportation system of claim 16, further including a fire alarm panel to which the combustion detectors are coupled, and the control unit is an interconnection device that communicates with the combustion detectors and the elevator controller, the interconnection device having a central processing unit that establishes the emergency evacuation zone.

23. The vertical transportation system of claim 16 further including a combustion detector connected to the elevator car, the car combustion detector being operatively connected to the control unit and adapted to send an emergency detection signal to the control unit when the car combustion detector detects a combustion by-product, the control unit being configured to send a deactivation signal to the elevator controller to deactivate the elevator car in response to the control unit receiving the emergency detection signal, the elevator controller moving the elevator car to a parked, out-of-service position in the building in response to the deactivation signal.

24. The vertical transportation system of claim 16 wherein a plurality of the floors each have a floor lobby, and each of the floor lobbies has a floor lobby detector, the floor lobby detectors being coupled to the control unit, each floor lobby detector providing an emergency signal to the control unit when the floor lobby detector detects a combustion byproduct in the floor lobby, the control unit being configured in response to the emergency signal to send a by-pass signal to the elevator controller that prevents the elevator car from being used to evacuate building occupants from the floor with the floor lobby detector which detected the combustion by-products.

25. A method of evacuating building occupants from a building having a plurality of floors, including a building exit floor, and an elevator car that is positionable at locations adjacent to selected ones of the floors, comprising the steps of:

detecting an emergency condition on a signaling floor in the building;

defining an evacuation zone in a portion of the building during the emergency condition, the evacuation zone including the signaling floor and an evacuation assistance floor that is a selected number of floors away from the signaling floor and that is not the building exit floor, the evacuation zone being defined not to include floors considered to be non-emergency floors other than the evacuation assistance floor;

moving the elevator car to the signaling floor to allow the building occupant to enter the elevator car from the signaling floor;

moving the elevator car from the signaling floor after at least one of the building occupants from the signaling floor has entered the elevator car, to the evacuation assistance floor to allow the building occupant from the signaling floor to exit the elevator car onto the evacuation assistance floor; and restricting the movement of the elevator car to not include movement of the elevator car to the non-emergency floors other than the evacuation assistance floor while the building occupant is being evacuated from the signaling floor.

26. The method of claim 25 wherein the step of detecting an emergency condition includes detecting smoke with a smoke detector on the signaling floor.

27. The method of claim 25 wherein the step of defining the evacuation zone includes defining the evacuation zone as including the signaling floor, a first evacuation priority floor located one floor away from the signaling floor in a first direction, a second evacuation priority floor located one floor away from the signaling floor in a second direction, and a third evacuation priority floor located two floors away from the signaling floor in the first direction, and the method further includes the steps of moving the elevator car to one of the first, second, and third evacuation priority floors and the signaling floor to allow building occupants to enter the elevator car therefrom and next moving the elevator car to the evacuation assistance floor.

28. The method of claim 27, further including the step of identifying an elevator call signal initiated from the one of the first, second, and third evacuation priority floors and the signaling floor, and wherein the step of moving the elevator car to one of the first, second, and third evacuation priority floors and the signaling floor, includes moving the elevator car to the identified floor from which the elevator call signal was initiated.

29. The method of claim 27, further including the step of identifying a plurality of elevator call signals initiated from at least two different ones of the first, second, and third evacuation priority floors and the signaling floor, and wherein the step of moving the elevator car to the one of the first, second, and third evacuation priority floors and the signaling floor, includes moving the elevator car to the one of the identified floors from which the elevator call signals were initiated with the highest evacuation priority first, considering the signaling floor as having the first highest evacuation priority, the first evacuation priority floor having the second highest evacuation priority, the second evacuation priority floor having the third highest evacuation priority, and the third evacuation priority floor having the fourth highest evacuation priority.

30. The method of claim 25 for use when the building has a hoistway and the elevator car is movably positioned in the hoistway, the method further including the step of monitoring the hoistway for an emergency condition, and upon detection of an emergency condition in the hoistway, moving the elevator car to a predetermined floor in the building and deactivating the elevator car with the elevator car being parked at the predetermined floor and out of service.

31. The method of claim 25, further including the step of monitoring the elevator car for an emergency condition, and upon detection of an emergency condition at the elevator car, moving the elevator car to a predetermined floor in the building and deactivating the elevator car with the elevator car being parked at the predetermined floor and out of service.

32. The method of claim 25 for use when the building has a hoistway and the elevator car is movably positioned in the hoistway, the method further including the step of determining a direction of air flow in the hoistway relative to the signaling floor, and if the direction of air flow is upwardly relative to the signaling floor, the step of defining the evacuation zone includes defining the evacuation assistance floor as being a floor below the signaling floor.

33. The method of claim 25 for use when the building has a hoistway and the elevator car is movably positioned in the hoistway, the method further including the step of determining a direction of air flow in the hoistway relative to the signaling floor, and if the direction of air flow is downwardly relative to the signaling floor, the step of defining the evacuation zone includes defining the evacuation assistance floor as being a floor above the signaling floor.

34. A method of automatically evacuating building occupants from a building having a plurality of floors, including a building exit floor, a hoistway and an elevator car movable in the hoistway to locations adjacent to selected ones of the floors, comprising the steps of:

detecting smoke on a first evacuation priority floor of the building, thereby identifying an emergency condition in the building;

automatically defining an evacuation zone in a portion of the building upon identification of the emergency condition, the evacuation zone including the first evacuation priority evacuation floor and an evacuation assistance floor that is not the building exit floor, the evacuation zone being defined not to include floors considered to be non-emergency floors other than the evacuation assistance floor;

moving the elevator car from the evacuation assistance floor to the first evacuation priority floor to allow an occupant of the first evacuation priority floor to enter the elevator car;

determining whether the occupant of the first evacuation priority floor has entered the elevator car;

moving the elevator car from the first evacuation priority floor to the evacuation assistance floor in response to determining an occupant entering the elevator car;

allowing the occupant of the first evacuation priority floor to exit the elevator car only at the evacuation assistance floor; and restricting movement of the elevator car to not include movement of the elevator car to floors defined as non-emergency floors other than the evacuation assistance floor while the occupants of the first evacuation priority floor are being evacuated after the elevator car has first moved to the evacuation priority floor during the identified emergency condition.

35. The method of claim 34, further including the step of moving the elevator car to the evacuation assistance floor after identification of the emergency condition.

* * * * *